US007564009B2

(12) United States Patent
Caldwell

(10) Patent No.: US 7,564,009 B2
(45) Date of Patent: Jul. 21, 2009

(54) SPOT WARMING DEVICE, AND METHOD

(75) Inventor: Wilbur Caldwell, Clinton, MO (US)

(73) Assignee: EZ Innovations, LLC, Clinton, MO (US)

( * ) Notice: Subject to any disclaimer, the term of this patent is extended or adjusted under 35 U.S.C. 154(b) by 30 days.

(21) Appl. No.: 11/581,684

(22) Filed: Oct. 16, 2006

(65) Prior Publication Data

US 2007/0084843 A1 Apr. 19, 2007

(51) Int. Cl.
*H05B 1/02* (2006.01)

(52) U.S. Cl. ..... 219/528; 219/541; 219/494; 392/435

(58) Field of Classification Search ..... 219/211, 219/212, 527–529, 541–545, 549, 517, 217, 219/390; 392/435, 436
See application file for complete search history.

(56) References Cited

U.S. PATENT DOCUMENTS 3,397,301 A * 8/1968 Hager, Jr. ..... 392/435
4,158,078 A 6/1979 Egger
4,665,308 A 5/1987 Courvoisier
5,486,680 A * 1/1996 Lieberman ..... 219/211
5,643,480 A 7/1997 Gustavsson
5,977,517 A 11/1999 Grosjean
6,066,164 A 5/2000 Macher
6,097,009 A * 8/2000 Cole ..... 219/528
6,218,644 B1 * 4/2001 Zorn et al. ..... 219/211
6,426,489 B1 * 7/2002 Elsasser ..... 219/543
6,452,138 B1 * 9/2002 Kochman et al. ..... 219/549
6,545,253 B2 4/2003 Lin
6,548,789 B1 4/2003 Rock
6,632,516 B2 * 10/2003 Aanestad ..... 428/304.4
6,657,164 B1 * 12/2003 Koch ..... 219/211
6,737,610 B1 5/2004 Horn

* cited by examiner

*Primary Examiner*—Mark H Paschall
(74) *Attorney, Agent, or Firm*—David E Herron, II

(57) ABSTRACT

The disclosure depicts a spot-warming device, and a method of making the same.

16 Claims, 6 Drawing Sheets

SPOT WARMING DEVICE, AND METHOD

SUMMARY OF THE INVENTION

The invention is a spot warming device, and a method of making the same.

THE INVENTIVE METHOD

The invention includes a method of making a spot warming device including the steps of providing a pliable, thin sheet of metal, and a length of wire having a pair of ends. The inventive method also includes the step of adhering the wire to a first face of the metal plate, and positioning foil insulation product atop the first face and the wire. Finally, the inventive method also includes the step of enveloping the sheet and foil insulation product within cover, preferably made of a durable cloth.

Optionally, the method may also include the steps of connecting a battery to each of the ends of the wire. In a preferred embodiment, the adhering step includes the steps of positioning a first layer of two sided tape on the first face of the thin metal plate. Next, the wire is pressed onto the two sided tape.

Optionally, another layer of two sided tape may be placed on top of the first layer. In a preferred embodiment, the wire is positioned between the first and second layers of two sided tape.

In order to increase the stability and predictability of the invention, it is preferred to use a double layer of two sided tape both beneath and above the wire, making four layers in all.

In a preferred embodiment, the method will include the steps of positioning the wire so that each of the pair of ends extends outwardly from the metal plate. Then, each of the ends of the outwardly-extending wire can be connected to a respective terminal of a battery. In an alternate embodiment of the invention, the method may include a step of positioning a switch adjacent an edge of the thin metal plate, and selectively activating the spot warming device by tripping the switch. The switch may be a three way switch having a first position, wherein the switch creates an open circuit, and a second position wherein the switch creates a circuit directing current through half of the wire, and a third position wherein the switch directs current through the entire length of the wire.

The inventive method may also include the step of providing a fuse and electrical communication with the battery and the wire, and configuring the fuse to create an open circuit when the devise reaches a selected temperature. Additionally, the metal plate may comprise aluminum, and the battery may be enclosed within the cover, or it may be positioned exterior the cover or even in a pouch located on an exterior portion of the cover. A clip may be included to attach the device to a wearer's clothing.

THE INVENTIVE DEVICE

The invention is also a warming device comprising a pliable, thin metal plate, and a length of wire having a pair of ends. The wire is adhered to a first face of the metal plate, and foil insulation product is positioned atop the first face and the wire. Finally, the inventive device includes a cover enveloping the metal plate, the wire, and the foil insulation. Of course, the ends of the wire may protrude outwardly from the cover in order to allow a battery to be connected to the ends of the wire.

In a preferred embodiment of the invention, a layer of two sided tape is positioned on the first face of the thin metal plate alternatively, a double layer of two sided tape may be positioned on the first face of the thin metal plate. Also, the wire may be positioned between the first and second layers of two sided tape.

The device may include a three way switch positioned adjacent an edge of the metal plate. The switch is preferably a three way switch having a first position, wherein the switch creates an open circuit, and a second position wherein the switch directs current through half of the wire, and a third position wherein the switch directs current through the entire length of the wire. Alternately, the inventive device may include a fuse an electrical communication with the battery and the wire, wherein the fuse creates an open circuit when the device reaches a selected temperature. The metal plate may be any pliable yet sturdy metal, such as aluminum. Additionally, the device may include an external battery, wherein wires protrude from ends of the metal plate and connect to a battery, or may include an internal battery, wherein the battery is enveloped within the cover.

DETAILED DESCRIPTION OF THE PREFERRED EMBODIMENTS

Figure 1:
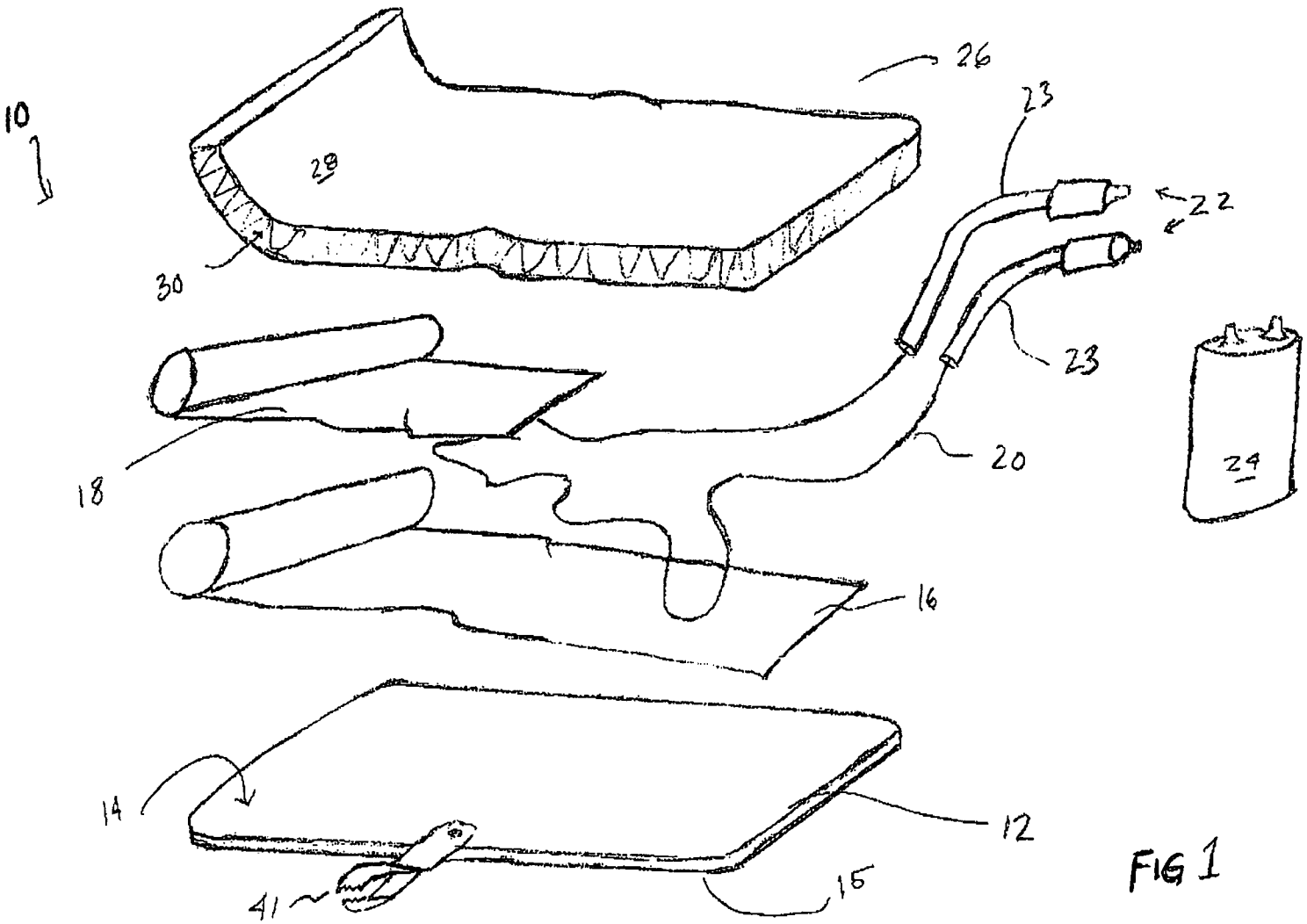
FIG. 1 is an exploded, perspective view of the warming device.

FIG. 1 shows the inventive system 10, which comprises a thin metal plate 12 having a first face 14 and a second face of 15. A wire 20 is positioned atop the first face 14 of the metal plate 12. The system may also include a clip 41 extending from an edge of the metal plate 12.

Still referring to FIG. 1, preferably the metal plate is a lightweight, pliable metal, such as aluminum. Additionally, a layer of double sided tape 16 may be positioned between the first face 14 and the wire 20 in order to retain the wire in a selected position. In a preferred embodiment, the system 10 may include two layers of double sided tape 16 affixed to the first face 14 of the plate 12.

Still referring to FIG. 1, a second layer of double sided tape 18 may be positioned atop the first layer, thereby sandwiching the wire 20 between the first layer 16 and second layer 18 of double sided tape.

Still referring to FIG. 1, in a preferred embodiment, the ends 22 of the wire 20 will extend beyond an edge of the plate 12. Ends of the wire 20 are preferably coated with insulation 23, and the ends 22 are equipped with plugs connectable to a power source, such as a battery 24.

Still referring to FIG. 1, the system 10 will also include a foil insulation product positioned on top of the wire 20, the layers 16, 18 of two sided tape, and the first face 14 of the plate 12. The foil insulation of 26 will include at least one layer of plastic bubble insulation 30 sandwiched between foil layers 28.

Figure 2:
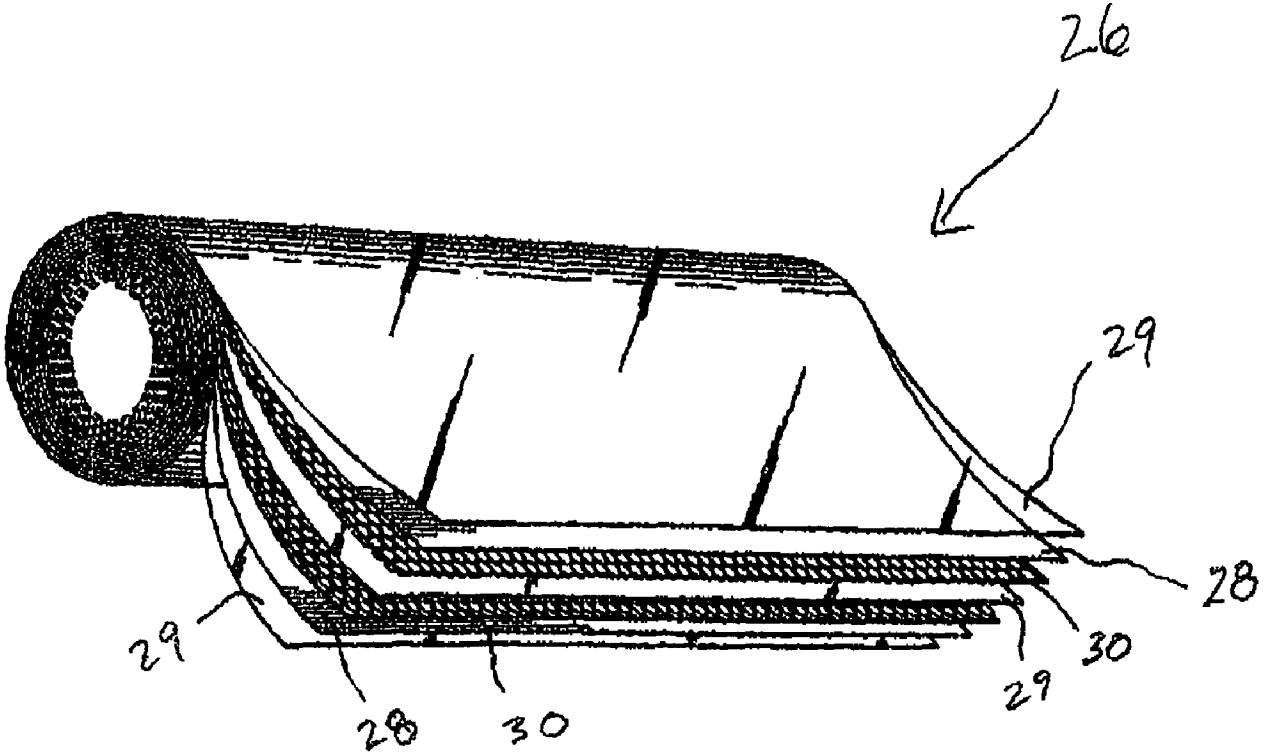
FIG. 2 is a perspective view isolating the foil insulation product and its components.

FIG. 2 is a detailed perspective view showing the various components of the foil insulation 26. The foil insulation product 26 may have a double layer of bubble wrap 30 sandwiched between layers of foil 28. Optionally, a polyester/sealant layer may be sandwiched between the two layers of bubble wrap 30. Additionally, the foil insulation 26 may also include additional layers of polyester/sealant/coating 29 over the respective foil layers 28.

Still referring to FIG. 2, the foil insulation product 26 is known, as shown in U.S. Pat. No. 6,632,516 issued to Rangvald and Aanestad. The entire disclosure of this U.S. patent is hereby incorporated by reference as is set forth verbatim herein.

Figure 3:
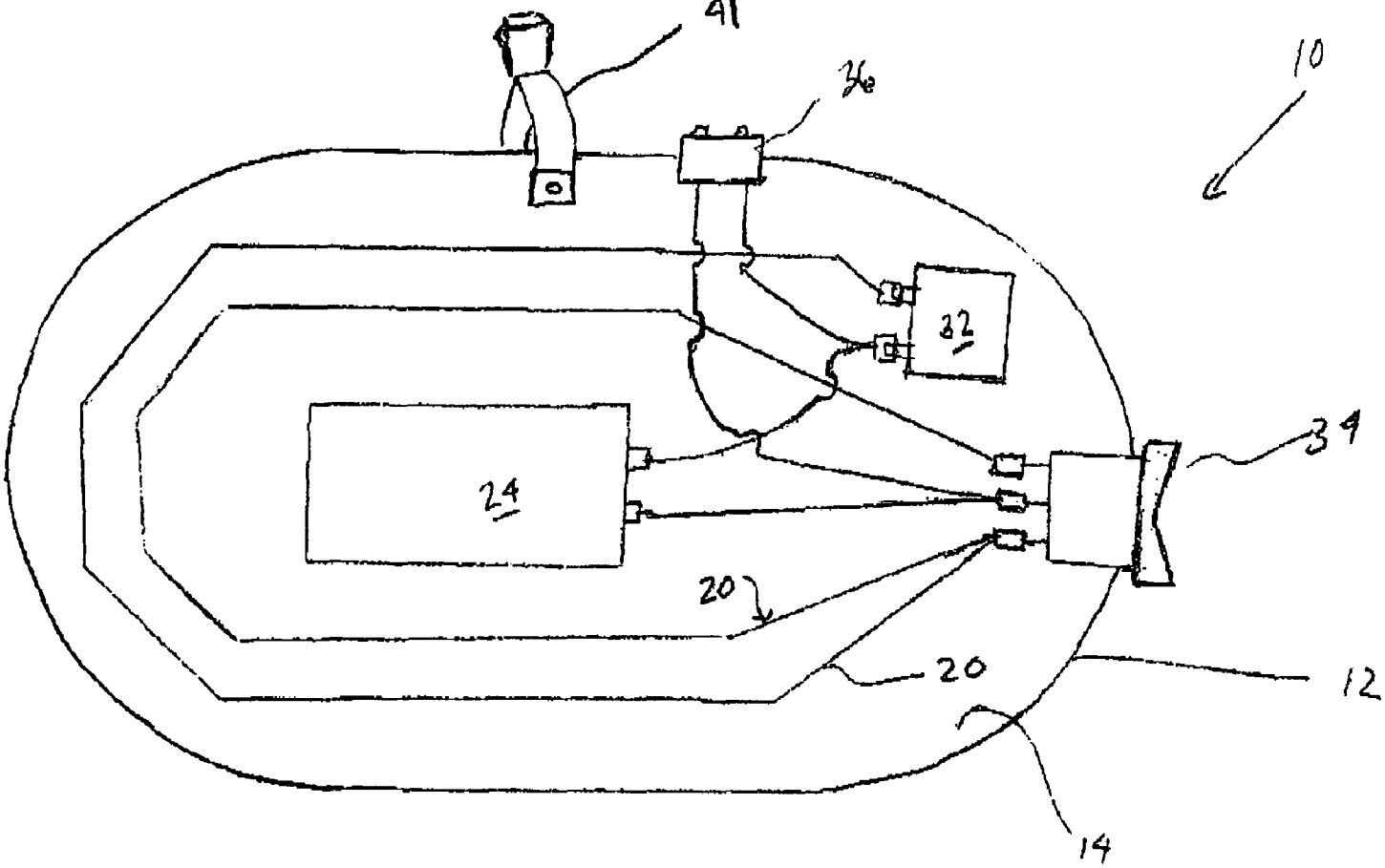
FIG. 3 is a plan view of a preferred embodiment of the invention.

FIG. 3 is a plan view showing an alternate embodiment of the system 10. Wire 20 is positioned and configured within the perimeter of the first face 14 of the plate 12. A switch 34 is positioned adjacent an edge of the plate 12, and is in electronic communication with the wire 20 and the battery 24. Preferably, the switch 34 is a 3-way spdt switch that enables a user to select a direct current through either half the length of the wire 20 (i.e., the inner configuration), or the entire length of the wire 20 (both the inner and outer loop of wire 20). The switch 34 may also be tripped to create an open circuit.

Still referring to FIG. 3, the system 10 may also include a fuse 32 positioned on a first face 14 of the plate 12 and configured to create an open circuit if the temperature or amperage exceeds a selected level. Preferably, the fuse 32 is a 3 amp blade type fuse that may be pressed onto the two sided tape (shown in FIG. 1).

Still referring to FIG. 3, a connector 36 may be positioned adjacent an edge of the plate 12, and configured to be an electric communication with the switch 34 and battery 24. Preferably, the connector 36 may be hooked up to a battery charger, enabling one to recharge battery 24. Preferably, battery 24 comprises a 7.2 volt standard battery, but admittedly other types of batteries may be used or developed within the scope of and breadth of the invention. A clip 41 may be attached to the metal plate 12, and configured to extend beyond an edge of the plate 12 so that the clip 41 can grip an article of clothing, or the like, in order to retain the system 10 in a selected position.

As shown in FIG. 3, the battery 24 is pressed onto the first face 14, and atop the layers of two-sided tape the foil insulation product 26 (not shown in FIG. 3; viewable in FIG. 1) may then be pressed onto and on top of the entire assembly that is shown in FIG. 3. Alternatively, another layer of two sided tape may be sandwiched between the battery and the foil insulation product 26. Thus, the embodiment shown in FIG. 3 details a self-contained system 10 with no wires protruding from any of the edges of the plate 12. Finally, the system 10 may be enveloped within a cover 38 such as a cloth or pouch.

Figure 4:
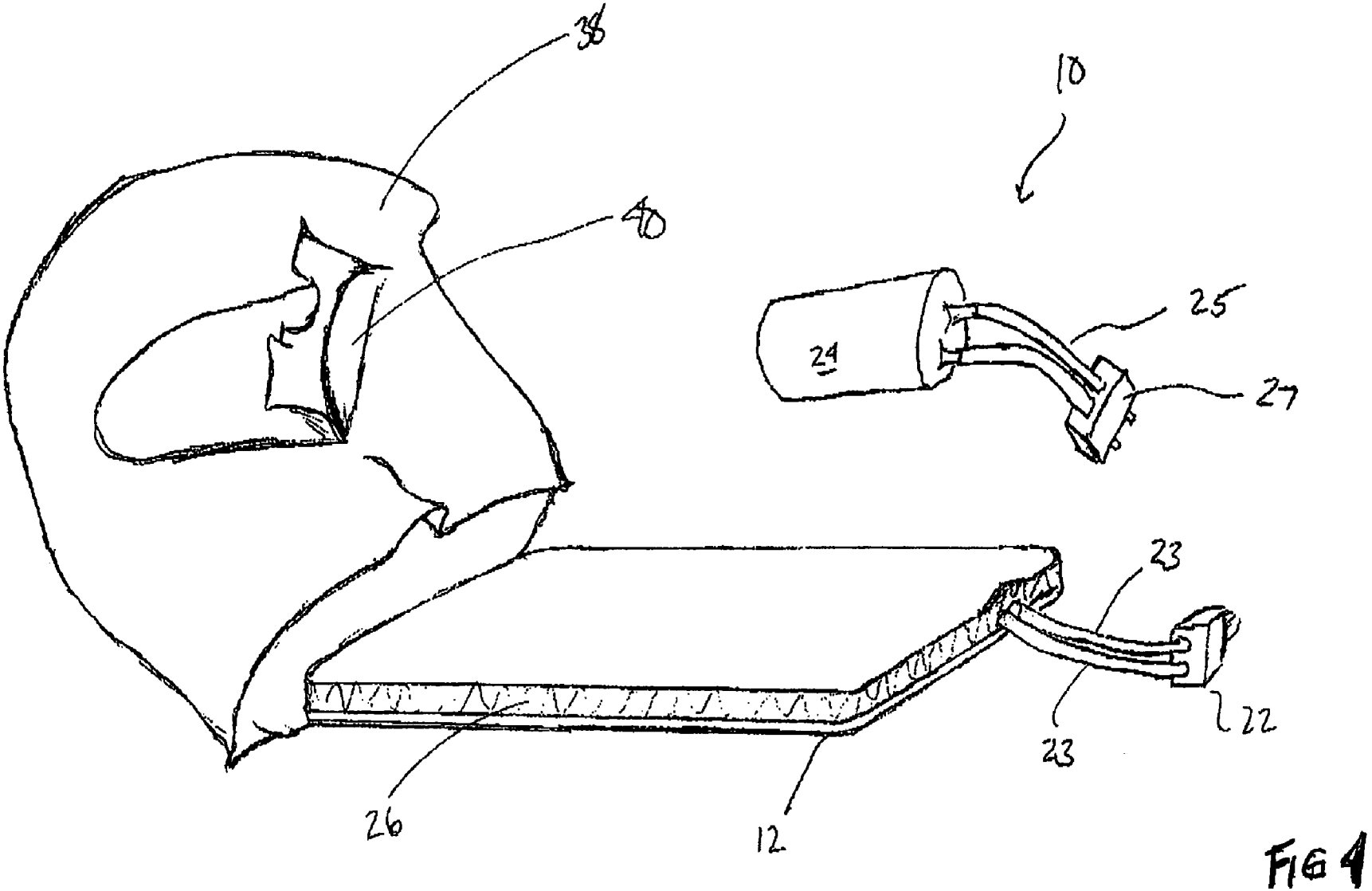
FIG. 4 is a perspective view of an alternate embodiment of the invention.

FIG. 4 shows a perspective view of another embodiment of the system 10 as in other embodiments, the system 10 includes a plate 12 having a foil insulation product 26 adhered there to, and sandwiched between (not visible in FIG. 4) a length of wire, preferably nichrome wire. Of course, other types of wire, such as nickel or copper wire may be used. Extending from an edge of the plate 12 are insulated ends 23 of the wire, terminating with posts 22. The posts 22 are configured to engage plug 27 which in turn connects battery leads 25 to the battery 24. In this embodiment, the plate 12 and foil insulation 26 are enveloped within a cover 38, and the battery 24 will be located exterior the cover, such as on a pouch 40 formed on the cover 38.

Still referring to FIG. 4, after the plate 12 and foil insulation 26 are slide into the cover 38, it is preferred that the cover be sewn shut. In this embodiment, the insulated leads 23 should extend outwardly from the system 10, and extend beyond the cover. Alternatively, the entire system 10 may be enclosed within the cover. In this embodiment, however, it is preferred that cover 38 include a means for selectively opening and closing the cover in order to remove, and/or recharge the battery 24.

As an alternative to the embodiment shown in FIG. 4, the cover 40 may be configured to envelop the battery 24 within the cover 40, making the entire system 10 self-contained within the cover 40. In another alternate embodiment, the battery 24 and the cover 40 may include hook and loop fastener to retain the battery in a selected position on the cover 40.

Figure 5:
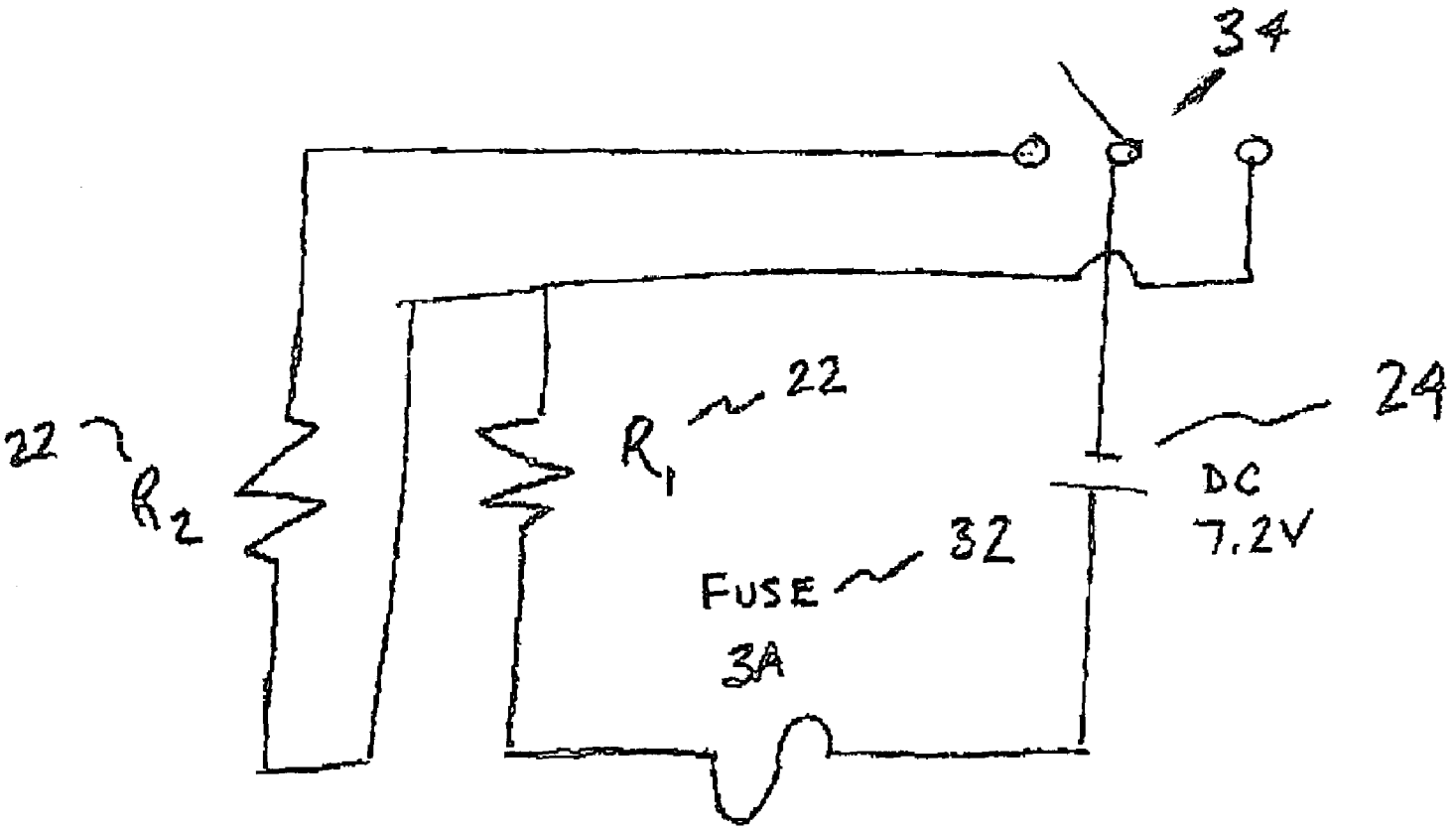
FIG. 5 is an exploded and perspective view of another embodiment of the invention.

FIG. 5 shows a perspective view of another embodiment of the system 10' As in other embodiments, this system 10' includes a plate 12 having a foil insulation product 26 adhered there to, and sandwiched therebetween is a length of wire, preferably nichrome wire, which will be connected to leads 20 that connect with the toggle switch (preferably a three-way toggle) 34. Of course, other types of wire, such as nickel or copper wire may be used. Extending from an edge of the plate 12 are insulated ends 23 of the wire, terminating with posts 22. The posts 22 are configured to engage plug 27 which in turn connects battery leads 25 to the battery 24. In this embodiment of the system 10', the plate 12 and foil insulation 26 are enveloped within a cover 38, and the battery 24 will be located within the interior 39 the cover. Of course, the interior 39 of the cover 38 may also include a pouch to secure the battery.

Still referring to FIG. 5, the cover 38 include a flap 56 for selectively opening and closing the cover 38 in order to remove, and/or recharge the battery 24. The flap 56 may be held in a closed position on the cover 38 by any known method, such as hook and loop fastners 58, snaps, buttons, zippers, buckles, or the like.

Still referring to FIG. 5, the cover 38 is configured to envelop the battery 24 and the metal plate 12 and foil insulation 26 within the cover 38, making the entire system 10 self-contained within the cover 438. In another alternate embodiment, the battery 24 and the cover 38 may include means for retaining at least one of the battery and the system 10' in position within the cover 38. The means may included pouches, pockets, or fastening means positioned within the interior 39 of the cover 38.

As shown in FIG. 5, a pair of straps 50 extend from of the cover 38; free ends of the strap 50 have buckles 52,54 that are configured to engage one another so that the system 10' can be affixed or strapped to a wearer (not shown) at any selected area of the wearer's body.

Figure 6:
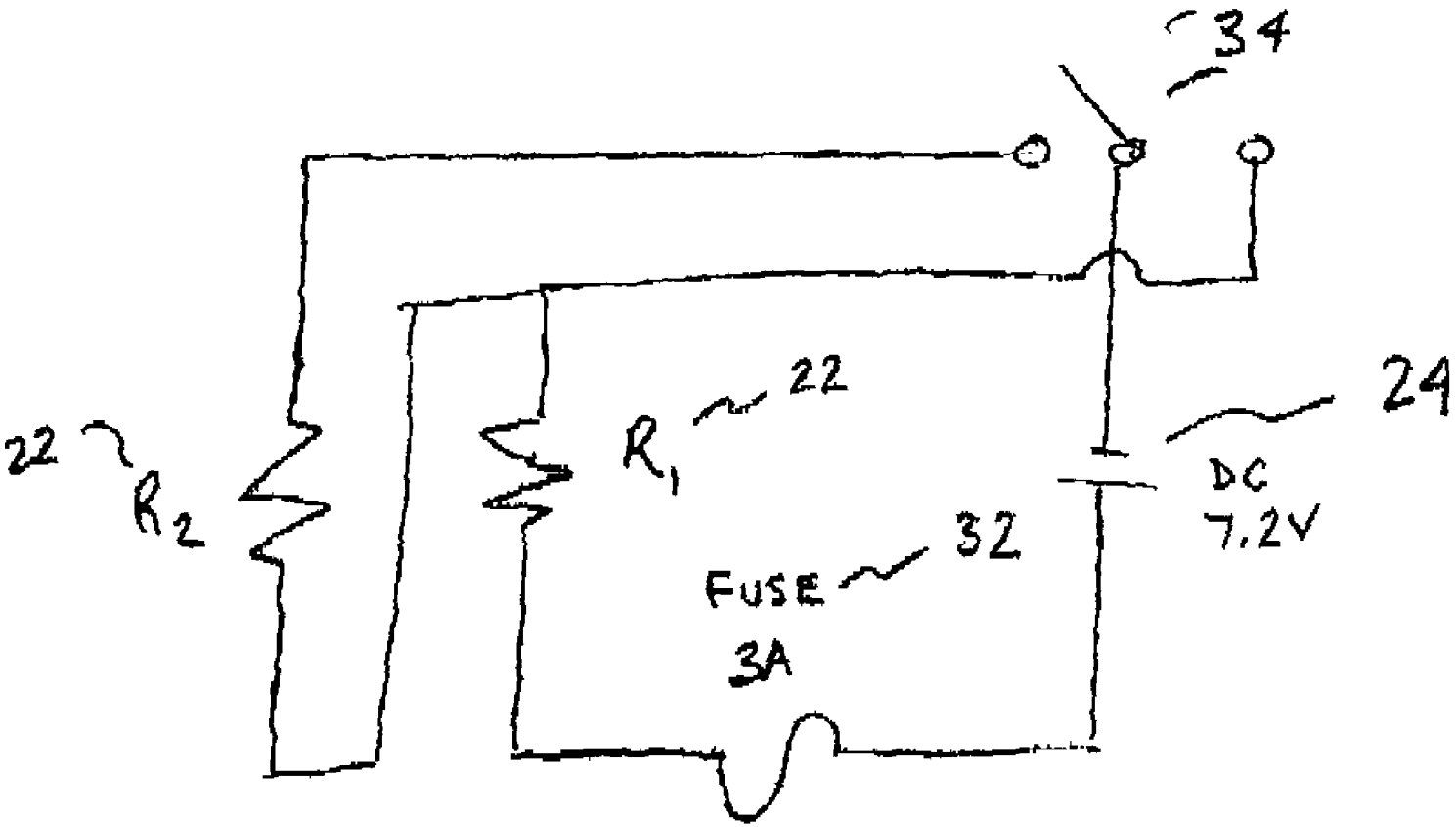
FIG. 6 is a schematic, circuit diagram showing the relationship with the electronic components.

FIG. 6 is a schematic diagram showing the basic electronics of the system 10. Note that the switch 34 may be a three way switch. As shown, the switch creates an open circuit; hence, the system is "off." However, if the switch is in a first position (to the right), then current will run through only one resistor $R_1$, for a low amount of resistance and a lower rate of heat output (i.e., a "low" setting). If the switch 34 is in a second position (to the left), then current will be induced both resistors $R_1$, $R_2$ for a higher amount of resistance, and consequently a higher rate of heat output (i.e., a "high" setting).

Having described the invention and its drawing and diagrams in detail, it is to be understood that these descriptions are for illustrative purposes. The scope and breadth of the invention shall be limited only by the appended claims.

I claim:

1. A method including the steps of:

providing a pliable, thin metal plate;

adhering a length of wire to a first face of the metal plate, the wire having a pair of ends;

providing an insulation product comprising multicellular bubble film for trapping insulative gases; and, a layer of polyethelene coating over the multicellular bubble film; and, a thin layer of foil on a top face;

engaging the top face of the insulation product into contact with the first face and the wire, thereby positioning the wire between the first face of the metal plate and the top face of the insulation product;

enveloping the plate and insulation product within a removable cover.

2. The method as in claim 1, further comprising the steps of connecting a battery to each of the ends of the wire.

3. The method as in claim 1, wherein the adhering step includes the steps of:

positioning a first layer of two-sided tape on the first face of the metal plate; and, pressing the wire onto the two-sided tape.

4. The method as in claim 3, further comprising the step of positioning a second layer of two-sided tape on top of the first layer.

5. The method as in claim 4, wherein the wire is positioned between the first and second layers of two-sided tape.

6. The method as in claim 1, further comprising the steps of positioning a first double-layer of two-sided tape on the first face of the plate; and, placing the wire onto the first double-layer of two-sided tape;

positioning a second double-layer of two-sided tape on top of the first double-layer of two-sided tape.

7. The method as in claim 1, further comprising the step of positioning the wire so that each of the pair of ends extends outwardly from the metal plate, and connecting each of the ends to a respective terminal of a battery.

8. The method as in claim 1, further comprising the steps of connecting the ends of the wire to a battery; and, positioning a switch adjacent an edge of the thin metal plate; and, selectively activating the spot warming device by tripping the switch.

9. The method as in claim 8, wherein the switch is a three-way switch having a first position wherein the switch creates an open circuit; and, a second position wherein the switch creates a circuit wherein current is directed through half of the wire; and, a third position wherein the switch creates a circuit wherein current is directed through an entire length of the wire.

10. The method as in claim 1, further comprising the step of selecting the metal plate of aluminum.

11. The method as in claim 2, further comprising the step of enveloping the battery within the cover.

12. The method as in claim 2, further comprising the step of providing a fuse in electrical communication with the battery and the wire; and, configuring the fuse to create an open circuit when the device reaches a selected temperature.

13. A device comprising:

a pliable, thin metal plate;

a length of wire having a pair of ends, the wire adhered to a first face of the metal plate;

insulation product positioned to engage both the first face and the wire, the insulation product comprising multicellular plastic bubble film for trapping insulative gases, a polyethylene coating over the plastic film, and a thin layer of foil covering a top face of the insulation product;

a cover enveloping the metal plate, wire, and insulation product;

a first layer of two sided tape adhered to the first face of the thin metal plate;

a second layer of two sided tape adhered to the insulation product; wherein the wire is positioned between the first and second layers of two-sided tape.

14. The device as in claim 13, further comprising a first double-layer of two-sided tape adhered to the first face of the metal plate;

a second double-layer of two-sided tape on top of the first double-layer of two-sided tape; and wherein, the wire is positioned between the first double layer and the second double layer.

15. The device as in claim 13, further comprising a battery; wherein, the wire is positioned so tat each of its pair of ends extends outwardly from the metal plate, and wherein, the pair of ends is connected to respective terminals of the battery.

16. The device as in claim 15, further comprising a three-way switch positioned adjacent an edge of the metal plate, the switch is a three-way switch having a first position wherein the switch creates an open circuit; and, a second position wherein the switch creates a circuit wherein current is directed through half of the wire; and, a third position wherein the switch creates a circuit wherein current is directed through an entire length of the wire.

* * * * *